United States Patent [19]

Michaux

[11] Patent Number: 4,615,201

[45] Date of Patent: Oct. 7, 1986

[54] SYSTEM FOR REPLACING SECTION ROLLING MILL STANDS, MULTI-FUNCTION STAND-BEARING TROLLEY FOR POSITIONING ON THE ROLLING SITES AND TRANSPORT TOWARDS THE PRE-ASSEMBLY SITES

[75] Inventor: Jacques Michaux, Joeuf, France

[73] Assignee: Sacilor, Hayange, France

[21] Appl. No.: 620,469

[22] Filed: Jun. 14, 1984

[30] Foreign Application Priority Data

Jun. 17, 1983 [FR] France ..... 83 10091

[51] Int. Cl.[4] ..... B21B 31/08

[52] U.S. Cl. ..... 72/239; 72/446

[58] Field of Search ..... 72/239, 446, 447, 448

[56] References Cited

U.S. PATENT DOCUMENTS

| | | | |
|---|---|---|---|
| 3,657,912 | 4/1972 | Ishibashi et al. . | |
| 3,712,102 | 1/1973 | Eibe | 72/238 |
| 3,899,910 | 8/1975 | Aramaki | 72/239 |
| 4,154,074 | 5/1979 | Sievrin et al. | 72/239 |
| 4,222,258 | 9/1980 | Field | 72/239 |

FOREIGN PATENT DOCUMENTS

| | | |
|---|---|---|
| 0002047 | 5/1979 | European Pat. Off. . |
| 0057101 | 8/1982 | European Pat. Off. . |
| 715601 | 12/1941 | Fed. Rep. of Germany . |
| 931705 | 1/1955 | Fed. Rep. of Germany . |
| 1012887 | 8/1957 | Fed. Rep. of Germany . |
| 1075079 | 2/1960 | Fed. Rep. of Germany . |
| 1602134 | 4/1970 | Fed. Rep. of Germany . |
| 1948026 | 3/1971 | Fed. Rep. of Germany . |
| 2701571 | 7/1978 | Fed. Rep. of Germany . |
| 1298605 | 6/1962 | France . |
| 1343332 | 10/1963 | France . |
| 1343333 | 10/1963 | France . |
| 1518288 | 2/1968 | France . |
| 2025705 | 9/1970 | France . |
| 1166432 | 10/1969 | United Kingdom . |

OTHER PUBLICATIONS

Draht 15, 1964, 5 by Otto Dopper.

*Primary Examiner*—Francis S. Husar
*Assistant Examiner*—Jorji M. Griffin
*Attorney, Agent, or Firm*—Stiefel, Gross, Kurland & Pavane

[57] ABSTRACT

The system according to the invention comprises: stand-bearing trolleys capable of independent displacements in the longitudinal and transverse directions, each constituted by two longitudinal members on which the stand is fixed and supported by axle-less wheels driven by on-board motors and by two transverse members supported by axle-less wheels driven by on-board motors; longitudinal and transverse tracks connecting the rolling sites, the siding sites and the pre-assembly sites; intersections of tracks; counter-rails disposed vertically on either side of the tracks; hydraulic jacks serving to fix the stands on the trolleys and for lifting the stands for adjusting the level of the rolling plane; bed plates upstream and downstream of the rolling sites serving to lock the stands in rolling position; on the rolling sites, coupling hooks serving for the precise positioning of the stands in rolling position and where necessary for the displacements of the stands during rolling, to bring different passes into the rolling axis of the rolling mill.

12 Claims, 8 Drawing Figures

SYSTEM FOR REPLACING SECTION ROLLING MILL STANDS, MULTI-FUNCTION STAND-BEARING TROLLEY FOR POSITIONING ON THE ROLLING SITES AND TRANSPORT TOWARDS THE PRE-ASSEMBLY SITES

The present invention generally relates to light, medium and heavy section rolling mills and more particularly to a system for rapidly changing the stands, also serving for transverse displacement of the stands during rolling.

A change of the section to be rolled involves at a minimum the replacement of all or part of the rolls and the outfit of a rolling mill. For old-design or low-productivity rolling mills which comprise stands permanently fixed on the rolling site, replacement of the rolls is effected on the rolling site, with the aid of travelling cranes. This modus operandi is no longer acceptable, as it involves periods of immobilization of the rolling mill of the order of three hours and more. Attempts have been made to reduce the duration of immobilization of the rolling mills by using platform trolleys for replacing the rolls (French Pat. Nos. 1 343 332 and 1 343 333) or roll cassettes (IRON AND STEEL ENGINEER, May 1970, page 79—German DOS 1 602 134 and 2 701 571). These latter two solutions require a special design of the stands, with wide windows, to allow lateral extraction of the rolls or the cassettes through the windows. The major drawback of these last two solutions is that they require special stands, which are heavy and therefore expensive, and especially not very rigid due to the necessarily large width of the windows. Replacement of complete stands by other stands prepared in the workshop is known. Replacement of the complete stands makes it possible to reduce the duration of immobilization to acceptable values, of the order of half and hour in the best of cases. Travelling cranes have been used for handling the stands, but at the cost of high investments in heavy cranes and superstructures capable of supporting the latter and the stands transported. Trolleys have also been used for ensuring handling of the stands between the rolling sites and the pre-assembly workshops, firstly for wire rolling mills (DRAHT 15, 1964, 5, "Neuartiges Drahtfertiggerüst für hohe Walzgeschwindigkeiten" by Otto DOPPER), then for section rolling mills.

French Pat. No. 1 518 288 discloses for example a frame bearing a plurality of continuous rolling mill stands for rounds or small rods. The frame is supported by wheels mounted in bearings adapted to pivot about vertical axes. The frame is movable over tracks perpendicular and parallel to the seam. Turntables placed at the intersections of the tracks make it possible to pivot the wheels and to orient them in the desired direction of displacement. German Pat. No. 1 948 026 discloses, for this type of frame and intersections with turntables, a system incorporating mobile longitudinal members, independent of the frame, to ensure transport of the frame between the position of rolling of the stands and two positions which may be a standby position or a position at the intersection of the transport tracks parallel or perpendicular to the seam.

European Pat. No. 0057101 discloses a stand-holder trolley provided with wheels and movable solely over tracks perpendicular to the seam, the displacement parallel to the seam being effected with the aid of other bearing trolleys each capable of receiving two stands: the replaced stand and the replacement stand.

A rolling mill stand is known (European Pat. No. 02047) which is movable over tracks between a pre-assembly site and a rolling site. The stand is provided with four wheels of which two are driving. The underneath of the stand and the bed plates of the stand on the rolling site present inclined surfaces whose role is to raise the stand when it is placed in rolling position, so as to raise the wheels above the tracks. (As a variant, this Patent proposes a hydraulic lifting table for raising the stand). Four locking jacks incorporating horizontal pistons block the stand in rolling position. This solution presents the drawback of allowing independent displacement only in one direction, perpendicular to the rolling axis. A trolley is necessary for displacements parallel to the axis of rolling. This trolley, placed at the intersections of the directions of displacement, at a lower level, bears portions of tracks which enable the cage to pass over the intersections of the directions of displacement when it moves in the only direction possible for it, in independent manner. For displacements in the other direction, parallel to the rolling axis, the stand rests on the tracks of the trolley which ensures its displacement as far as another intersection of directions of displacement. German Pat. No. 1 075 079 discloses a lever device for stand locking by applying the stand on a bed plates and for release by raising the stand, said levers serving as track for the stand provided with wheels. The adjustment of the height of the rolling plane is known, by interposition of shims of appropriate thicknesses between the bed plate and the stand fixing lugs. The stand-bearing trolleys of the state of the art fulfill, in one case, functions of fixation and of handling of the stands, in other cases, an additional or sole function of displacement of the stands in rolling position, to bring axes of different passes into the rolling axis of the rolling mill. FIG. 3 of the article in DRAHT 15 mentioned above shows a stand movable perpendicularly to the rolling axis. The rolls of this stand bear two passes placed side by side which are brought in turn into the rolling axis by the lateral displacement of the stand and its trolley. This displacement of the stand is ensured by a hydraulic jack. German Pat. Nos. 715 601, 931 705 and 1 012 887 firstly, then French Pat. Nos. 1 298 605 and 2 025 705 have also recommended the use of a stand movable perpendicularly to the rolling axis to bring different passes in turn into the rolling axis. The use of hydraulic jacks for displacing stands over slides or on trolleys onto the rolling sites is known.

The different known designs of self-propelling stand or of stand-bearing trolleys present in their functions:

of fixation of the stands, the drawback of being limited to given dimensions and types of stands. For example, in a mixed rolling mill, rolling an extensive dimensional range of various products, with universal and two-high stands or only with two-high stands, in which the dimensions (principally width) of the stands used vary with the products rolled, it would be necessary to have as many trolleys available as there are stands of different dimensions;

of adjustment of the rolling plane, the drawback of requiring heavy handling means for raising the stands.

of transport, the drawback of requiring additional bearing trolleys at the intersections of the directions of displacement, or of not allowing transport of stands whose lower parts lie at a level below the level of the tracks, and in particular at the intersections of the tracks perpendicular and parallel to the seam.

The use of additional bearing trolleys involves either using heavy travelling cranes on the pre-assembly sites for removing the stand from the additional bearing trolley, in order to release the latter to enable it to perform its role at the intersections; having as many bearing trolleys as there are self-propelling stands; or being able to have the pre-assembly sites of the stands available only perpendicularly to the rolling axis of the rolling mill.

In order to eliminate the above-mentioned drawbacks, the invention has for its objects a system for changing and handling stands comprising stand-bearing trolleys, for blocking the trolleys in rolling position, for modifying the rolling position of the stands, tracks and intersections of tracks, arrangements of the pre-assembly sites of the stands, which allow:

a standardization of the stand-bearing trolleys, thanks to a unique design allowing their use for stands of all types of dimensions, the adjustment of the rolling plane of the stands on the trolleys, whatever the type of stand used, variation of the width of the stands on the trolleys, without having to remove the stands from the trolleys, permanency of the standards of the stands on their trolleys during the changes of rolls and outfits on the pre-assembly sites, to avoid having to use heavy travelling cranes, displacements of the trolleys in both directions, longitudinal and transverse, without it being necessary to use additional bearing trolleys at the intersections for the changes of direction of displacement, blocking of the stands in rolling position on any rolling site, so as to be able as desired to align different axes of passes with the axis of a downstream roll train when the axis of the latter is different from that of the upstream roll train of a stand, a precise positioning of the stands in rolling position.

To attain the objects proposed thereby, the invention relates to:

A system comprising:

stand-bearing trolleys capable of independent displacements in the longitudinal and transverse directions, each constituted on the one hand by two longitudinal members on which the rolling mill stand rests and is fixed, each longitudinal member being supported by axle-less wheels driven by on-board motors and, on the other hand, by two transverse members each supported by axle-less wheels driven by on-board motors, at least one transverse member being provided on its outer face with a recess comprising a coupling bar, the stand-bearing trolleys further being provided with vertical-axis guide rollers placed at the corners of the stand-bearing trolleys in such a manner and at such spots that the rolling surfaces of the rollers are outside the longitudinal and transverse gauges of the stand-bearing trolleys, longitudinal and transverse tracks for the stand-bearing trolleys connecting the rolling sites and siding sites and pre-assembly sites, intersections of the track constituted by portions of longitudinal and transverse tracks retractable vertically in independent manner beneath the level of the tracks, counter-rails disposed vertically above and on either side of the longitudinal and transverse tracks as well as above and on either side of the retractable track positions, the counter-rails also being retractable in this latter case, hydraulic jacks rendered fast with the lugs of the stands serving on the one hand for fixing the stands on the stand-bearing trolleys and, on the other hand, for lifting the stands for adjusting the level of the rolling plane by the interposition of shims of appropriate thickness between the lugs of the stands and the upper surfaces of the longitudinal members of the stand-bearing trolleys, the hydraulic jacks being to this end provided with pistons comprising, at their free ends, heads which abut on the one hand under the wall of the upper part of the longitudinal members, to ensure fixation of the stands on the stand-bearing trolleys and, on the other hand, abut on supports housed in the longitudinal members, to ensure lifting of the stands, bed plates upstream and downstream of the rolling sites serving to lock the stands in rolling position, by lifting with the aid of hydraulic jacks stand-bearing trolleys and applying surfaces of the longitudinal members against opposite surfaces of the bed plates, on the rolling sites, on the stand control side, coupling hooks actuated by hydraulic jacks via substantially vertical levers on which are articulated the coupling hooks in the upper part of the levers and pistons of the hydraulic jacks in the central part of the levers, the levers being articulated at their lower part in stirrups, the coupling hook-lever-jack and piston assembly serving for the precise positioning of the stands in rolling position and, where necessary, for the displacements of the stands during rolling, to bring different passes into the rolling axis of the rolling mill.

A stand-bearing trolley of the above mentioned type in which the longitudinal members are provided, on their outer lateral faces, with longitudinal shoes having an upper surface inclined with respect to the horizontal and a horizontal lower surface.

A stand-bearing trolley of the above-mentioned type, in which the longitudinal members comprise on their upper surfaces soles on which abut the lugs of the stands, the soles being pierced with longitudinal slots, the longitudinal members also comprising beneath the slots horizontal surfaces acting as supports. It is also advantageous if at least the supports located on the same side of the transverse axis of symmetry of the stand-bearing trolley are movable longitudinally with the aid of hydraulic jacks.

A stand-bearing trolley of the above-mentioned type, provided with lifting jacks placed at its corners so that the pistons of the lifting jacks can abut on surfaces lying beneath the stand-bearing trolley.

A stand-bearing trolley of the above-mentioned type, in which the longitudinal members rest and are fixed by their ends on the ends of the transverse members.

An intersection of tracks of the above-mentioned type, which comprises at its four corners fixed ears fast with the fixed tracks against which the retractable track portions are flush and on which abut the pistons of the lifting jacks of the stand-bearing trolleys.

Fixed bed plates of the above-mentioned type which are provided, beneath their upper surface, on the one hand, with surfaces which make an angle with the horizontal, said angle being the supplement of the angle of the upper surfaces of the shoes of the stand-bearing trolleys, and, on the other hand, with lifting jacks placed so that their pistons may abut against the lower horizontal surfaces of the shoes.

The invention will be more readily understood on reading the following description with reference to the accompanying drawings, in which:

FIG. 6 is a schematic plan view of a rolling mill and the pre-assembly sites of the stands, with indication of the tracks of the trolleys.

Figure 1:
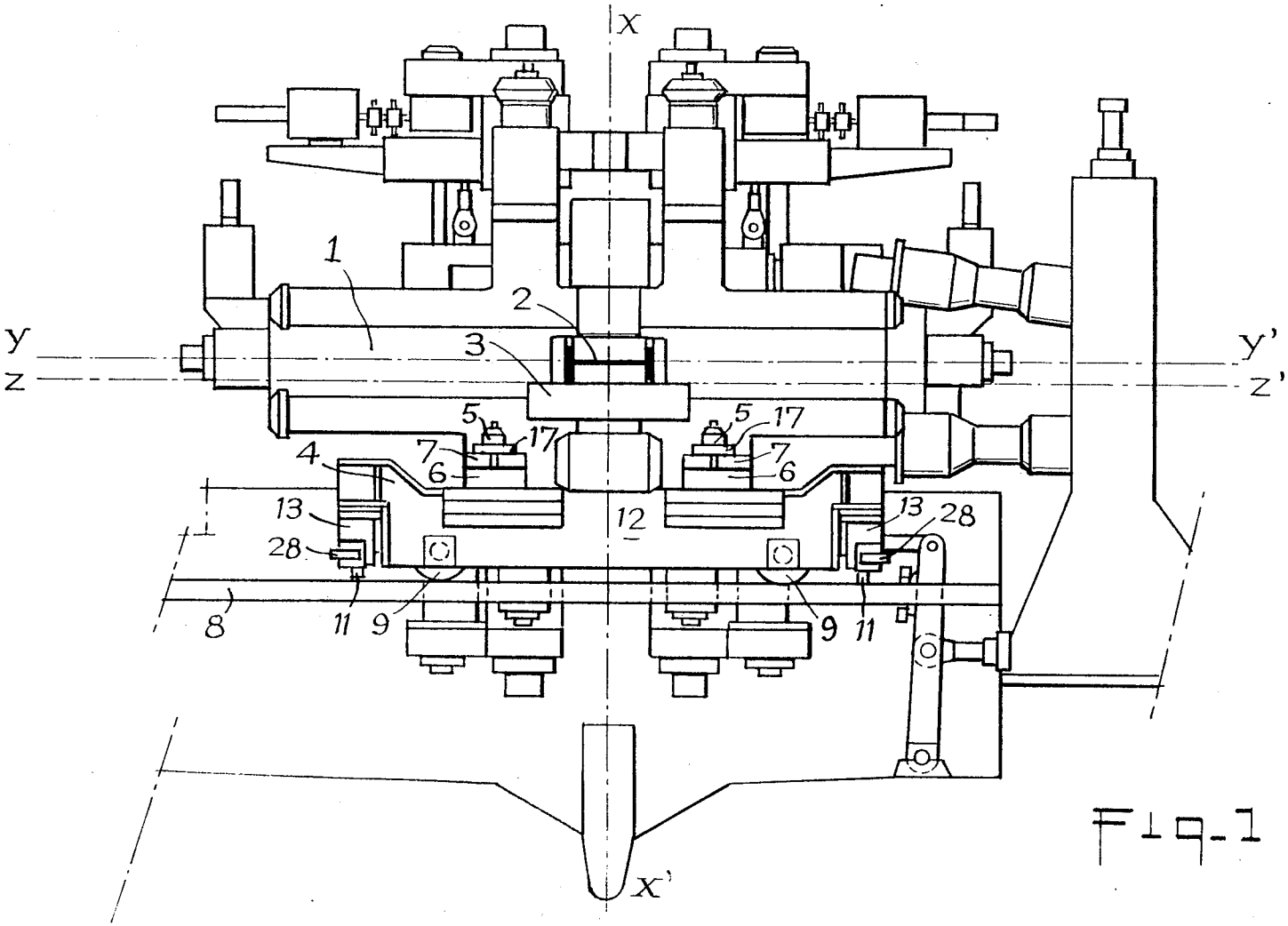
FIG. 1 is a front view of a universal stand mounted on a trolley of the invention, in rolling position, with partial section of the foundations.

Referring now to the drawings, FIG. 1 shows a rolling mill stand 1 on the rolling site. The stand shown is a universal stand rolling a girder in pass 2. XX' is the trace, on the plane of FIG. 1, of the vertical plane of symmetry of the stand 1, the pass 2 and the upstream and downstream roll trains, these latter being symbolically shown by a roll 3. XX' will be referred to as rolling axis. YY' which is the trace, on the plane of FIG. 1, of the horizontal plane of symmetry of the pass 2, will be referred to as rolling plane. ZZ' is the trace, on the plane of FIG. 1, of the horizontal plane tangential to the upper part of the lines of rolls. The stand 1 rests on a trolley 4 according to the invention. The stand 1 is fixed on the trolley 4 by jacks 5. The height of the rolling plane YY', i.e. the distance between the planes YY' and ZZ' is adjusted in known manner by the interposition of shims 6, of appropriate thicknesses, between the trolley 4 and the lugs 7 of the feet of the standards (FIG. 4) of the stand 1. The trolley 4 rolls over tracks 8. (Reference 8 denotes both the tracks and the rails of which they are composed). To this end, it is provided (FIG. 3) with wheels 9 and with motors 9' for driving the wheels 9. The tracks 8 and wheels 9 serve for the displacements of the trolley 4 perpendicularly to the rolling axis XX' (FIG. 6). Tracks and rails 10 serve for the displacements of the trolley 4 parallel to the rolling axis XX'. The trolley 4 is provided to this end with other wheels 11 driven by motors 11'.

In its preferred embodiment, the trolley 4 is self-propelling and is composed of two longitudinal members 12 and of two transverse members 13. These members are preferably constructed in the form of mechanically welded boxes. The ends of the longitudinal members 12 are advantageously placed on the ends of the transverse members 13, connection thereof being effected in appropriate manner, by bolting or welding for example. The upper parts of members 12 and 13 are shaped so as not to disturb the functioning of the parts of the supported stand. In particular, the upper parts of the transverse members 13 are notched to allow free rotation of the ends of the cylinders and the extensions.

Figure 4:
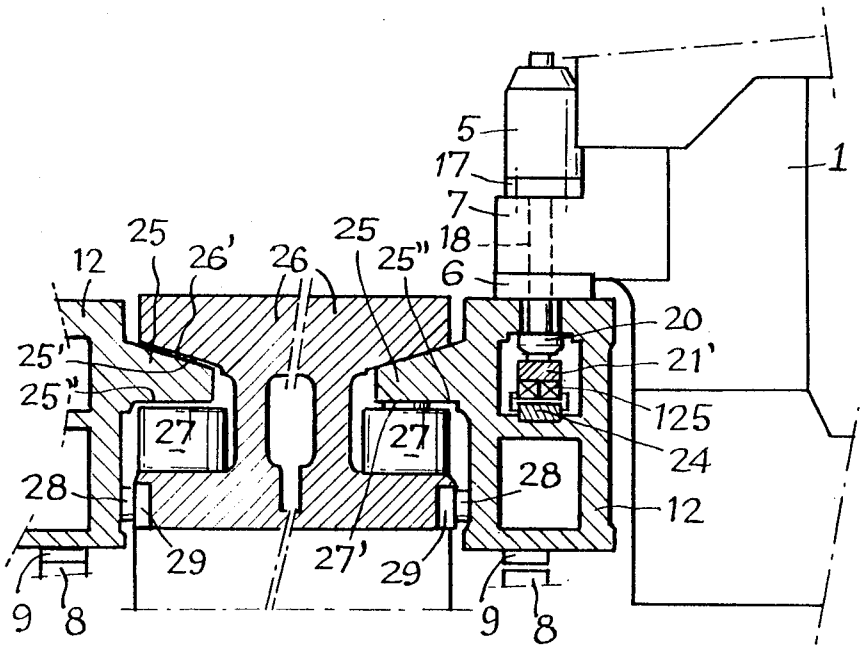
FIG. 4 is a partial section along IV—IV of the trolley and the entablature shown in FIG. 3, of a stand mounted on this trolley and of the fixed entablature and the trolley of another adjacent stand.
Figure 3:
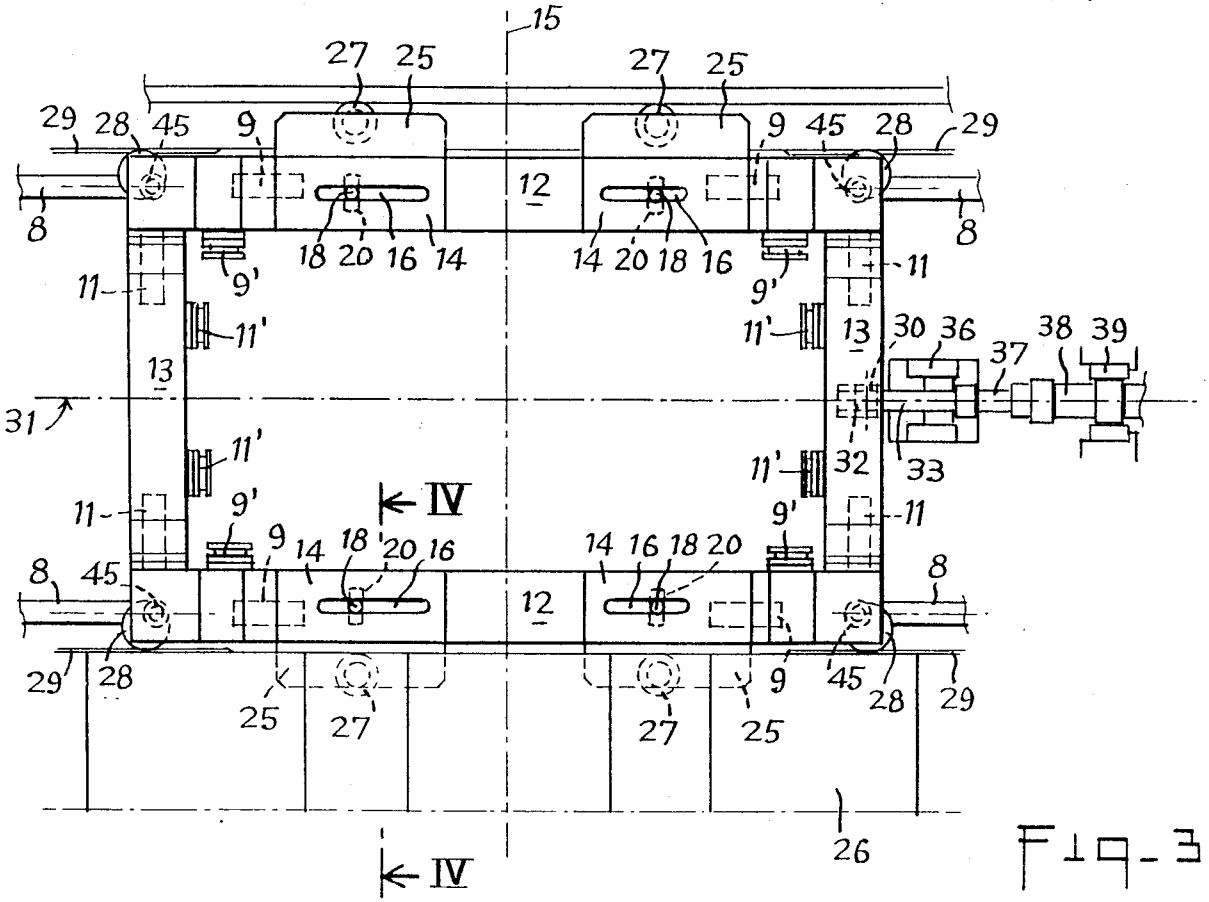
FIG. 3 is a plan view of the trolley of the invention in rolling position (the stand and the extensions not being shown). One fixed entablature is shown, in the lower part of the Figure.
Figure 5:
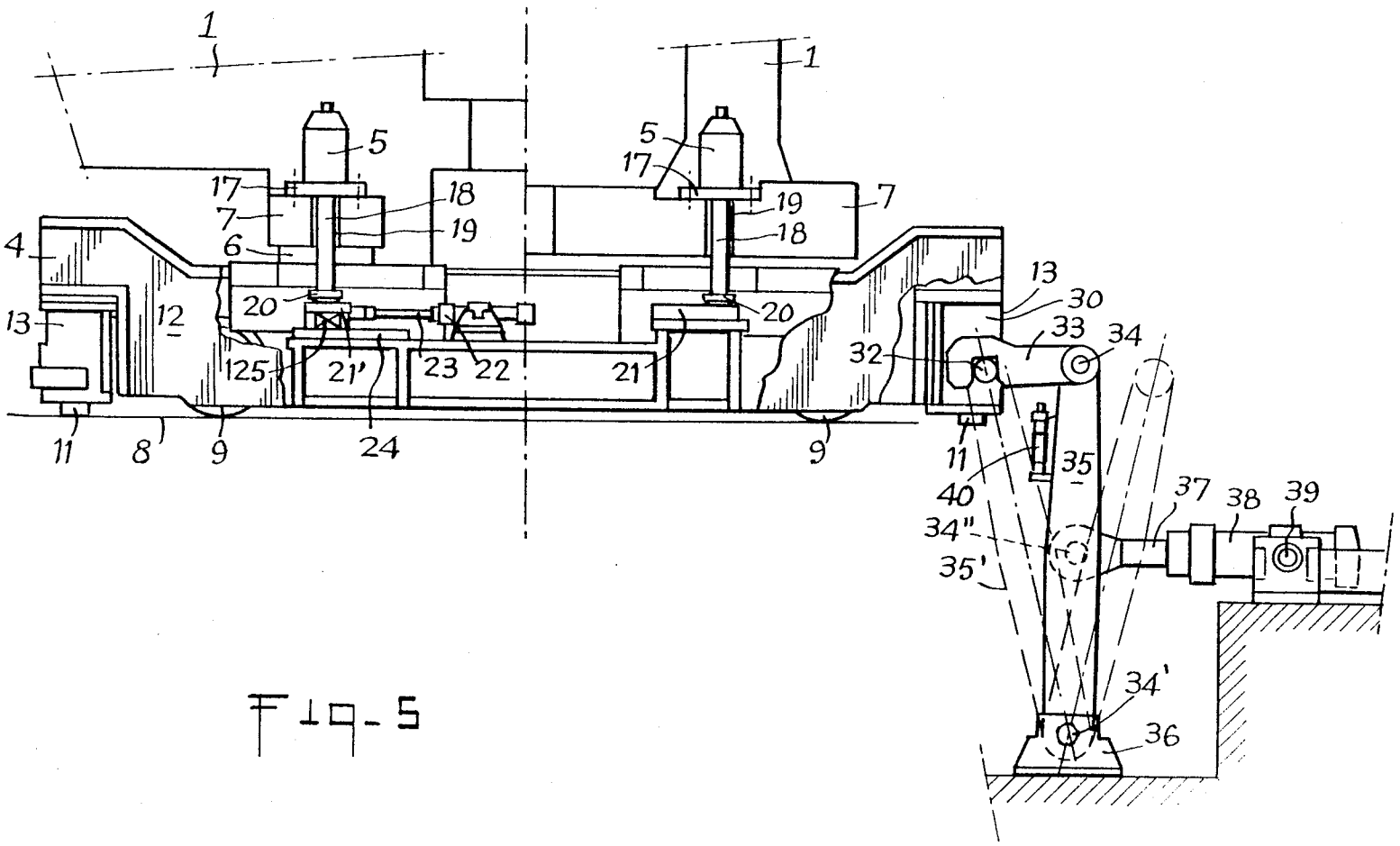
FIG. 5 is an enlargement of part of FIG. 1, partially in vertical section.
Figure 5:
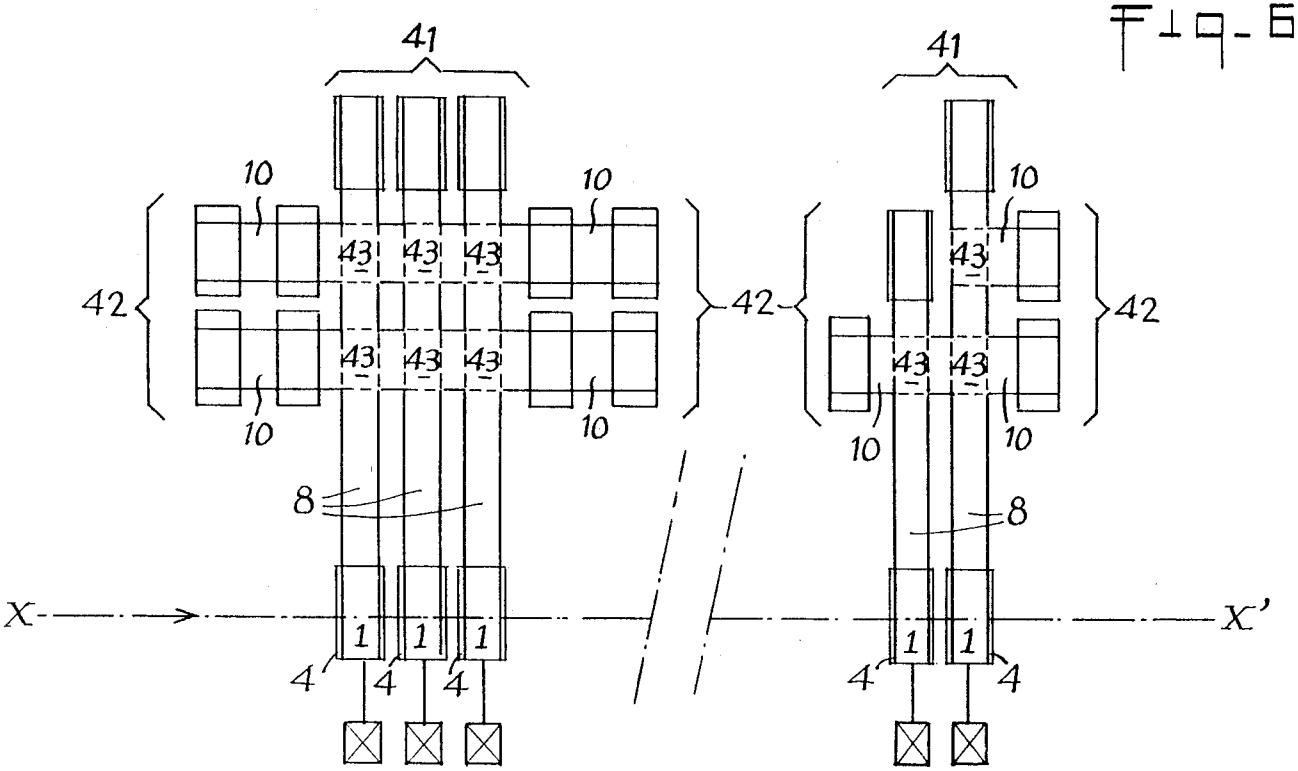

The rolling mill stands rest by their lugs 7 (FIG. 4) on the upper surface of the longitudinal members 12, at spots acting as soles 14 (FIG. 3). The soles 14 are located symmetrically with respect to the transverse axis of symmetry 15 of the trolley 4. Each sole 14 comprises a slot 16 cut out longitudinally in the upper part of the longitudinal member 12 and which opens out on the inside of the box formed by the latter. The hydraulic jacks 5 are rendered fast by their flanges 17 with the upper parts of the lugs 7 (FIGS. 4 and 5). The pistons 18 of the jacks 5 pass through the lugs 7, advantageously via openings made in the form of slits 19 (FIG. 5) open towards the outside of the stands. The pistons 18 penetrate in the longitudinal members 12 via slots 16. The pistons 18 comprise a head 20 at their free ends which penetrate in the longitudinal members 12. The heads 20 are advantageously rectangular in form, the width of said rectangle being less than the width of the slots 16 and the upper length of the width of the slots 16. FIG. 3 shows the head 20 in position of locking of the stand 1 on the trolley 4. (Stand 1 is not shown). A head 20 in position of locking of the stand 1 is also shown in FIG. 4. Upon assembly of a stand 1 on a trolley 4, the pistons 18, therefore the heads 20, are rotated so that they penetrate through slots 16 in the longitudinal members 12. When the stand 1 rests on the trolley 4, the pistons 18 are rotated so that the upper faces of the heads 20 can abut on the inner faces of the soles 14, on either side of the slots 16. The stand is then locked on the trolley 4 by lifting the pistons 18. On doing so, the jacks 5 perform a function of hydraulic nut. By lowering the pistons 18 and by causing the lower face of the heads 20 to bear on supports 21 (FIG. 5, right-hand part) provided in the longitudinal members 12, beneath the slots 16, the stand 1 may be raised and shims 6 may be slid between the lugs 7 and the soles 14. The shims 6, of appropriate thickness, make it possible to adjust, in known manner, the level of the rolling plane YY'. On doing so, the jacks 5 perform an additional function, that of lifting the stands. The length of the supports 21 is defined so as to allow lifting of stands of different widths. The supports 21 may all be fixed as shown in the right-hand part of FIG. 5. They may also be fixed on one side of the stand and mobile on the other side (as shown in the left-hand part of FIG. 5). In this case, the supports 21' are displaceable longitudinally to allow adjustment of the width of the stands on the trolleys 4. Lateral displacement will advantageously be effected with the aid of a hydraulic jack 22 whose piston 23, of appropriate length, rendered fast with support 21', makes it possible to slide or roll the support 21' longitudinally over a surface 24. Rolling bearings 125 will advantageously be interposed between the supports 21' and the surfaces 24. The stand 1 shown partially in the right-hand part of FIG. 5 is a two-high stand, that in the left-hand part is a universal stand, to show that the trolley 4, the jacks 5, slots 16, pistons 18, heads 20, supports 21 and 21' make possible not only the assembly of any type of stand on the trolleys 4 but also make it possible to use the trolleys 4 to vary the width of the stands.

Figure 2:
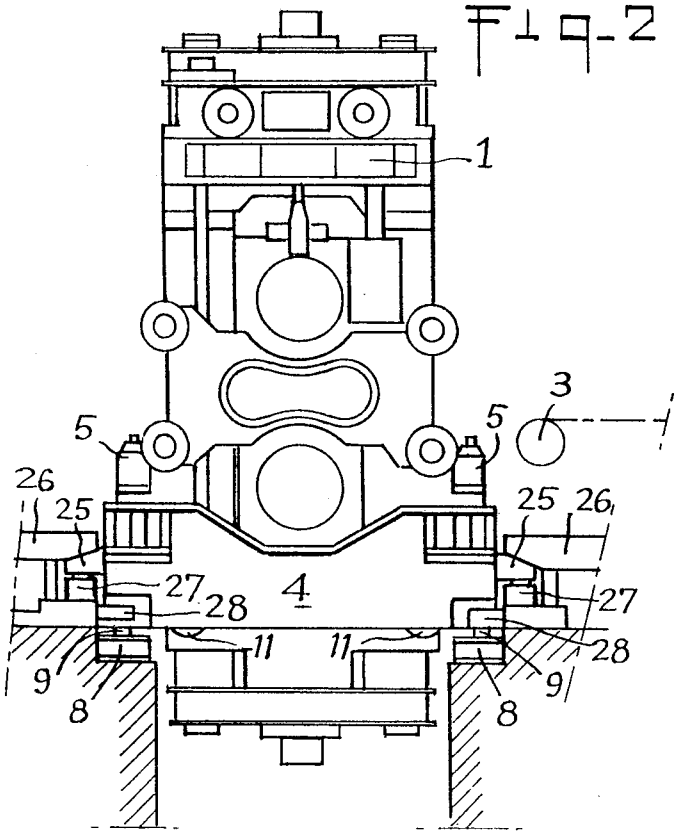
FIG. 2 is a view of FIG. 1 from the operator's side, with a partial section of the foundations and the fixed entablatures upstream and downstream of the stand.

The trolleys 4 are provided with shoes 25 (FIGS. 3 and 4) on the outer sides of the longitudinal members 12, level with the soles 14. The upper surfaces 25' of the shoes 25 make an angle with the horizontal, therefore with the sides of the longitudinal members, whilst their lower surfaces 25'' are horizontal, therefore perpendicular to the sides of the longitudinal members 12. The shoes 25 extend longitudinally over an appropriate length. The shoes 25 perform a function of locking of the trolleys 4 and consequently of the stands 1, when these latter are in rolling position. Bed plates 26 provided on the rolling sites, upstream and downstream of the stands, participate in the function of locking the trolleys 4 in rolling position. The bed plates 26 extend over the whole width of the rolling site. They comprise a lower surface 26' of which the angle with the horizontal is the supplement of the angle with the horizontal of the upper surface 25' of the shoe 25. Jacks 27 are provided in the bed plates (cf. also FIG. 2), beneath the surfaces 26'. The jacks 27 are mounted so that the lower surfaces 25'' of the shoes 25 can pass above the jacks 27 whilst the trolley 4 is rolling over the tracks 8 on the rolling site. The left-hand part of FIG. 4 shows a partial view of a trolley 4 in position of rolling on the rolling site. The surfaces 25' and 26' are not in contact. The surface 26'' does not touch the jack 27. The right-hand part of FIG. 4 shows a partial view of a trolley 4 locked in rolling position. The trolley 4 with stand 1 are raised by the jacks 27 of which the pistons 27' come into contact with the surfaces 25''. The surfaces 25' and 26' come into contact with each other to lock the trolley 4 on the fixed entablature 26. Unlocking of the trolley is effected in the opposite direction.

The trolley 4 comprises rollers 28 rotatable about a vertical axis which cooperate with counter-rails 29 to ensure guiding of the trolleys during their displacements over tracks 8 and 10 (the counter-rails 29 are shown only in FIGS. 3 and 4). The rollers 28 are placed at the angles of the members 12 and 13 and their rolling surfaces are outside the gauge of the trolley 4. On the rolling sites, the clearance between the rollers 28 and the counter-rails 29 is reduced in order to ensure precise positioning of the trolleys 4.

At least one of the transverse members 13 of the trolley 4 comprises a recess 30 accessible from the outside. The recess 30 (FIGS. 3 and 5) placed in the longitudinal axis 31 of the trolley 4 comprises a horizontal coupling bar 32. The trolley 4 is brought on the rolling site so that the recess 30 faces the motor side of the stand (FIG. 1). A hook 33 (FIG. 5) is engaged on the bar 32. The hook 33 is articulated about a horizontal pin 34 placed at the upper end of a lever 35 of which the lower end is articulated about a horizontal pin 34' fixed in a stirrup 36 fast with the foundations. A horizontal pin 34'' ensures the connection in the body of the lever 35 with a substantially horizontal piston 37 of a jack 38 pivotally mounted in a stirrup 39 fixed to the foundations. During positioning of a stand on the rolling site, the trolley 4 which is self-propelling, comes up to the vicinity of lever 35. The latter is then placed in its end hooking position 35' (shown by dotted lines) with the aid of jack 38. The hook 33 is engaged on the bar 32 and the jack 38-piston 37-lever 35 assembly serves for the precise positioning of the trolley 4 and of the stand 1 transported into rolling position. A hydraulic jack 40 fixed along the lever 35, beneath the hook 33, has for its function to raise the hook 33 to disengage it from the coupling bar 32 during the change of trolley 4 and stand 1 on the rolling site. After disconnection, the self-propelling trolley 4 moves away over tracks 8 and possibly 10 towards a pre-assembly site.

The lever 35 and its associated mechanisms described previously may also serve, in manner known per se, for the displacement of the stand 1 perpendicularly to the rolling axis XX', in the course of rolling, to present where necessary the axis of a different pass in the rolling axis. In this case, after passage of the bar in a pass, the trolley 4 is unlocked by release of the pressure in the jacks 27 (FIG. 4), lowered to cause the wheels 9 to rest on tracks 8, displaced with the aid of lever 35 to bring the axis of another pass in the rolling axis XX', and raised by jacks 27 to be locked in rolling position again.

When a section to be rolled is changed, the stands 1 (FIG. 6) are unlocked, disconnected from their extensions and their service supplies, to be taken from the rolling sites by trolleys 4 over tracks 8 to their provisional sidings 41. The replacement stands prepared and ready on the pre-assembly sites 42 are transported by their trolleys 4 firstly over tracks 10 up to intersections 43 then over tracks 8 up to their rolling sites.

Figure 8:
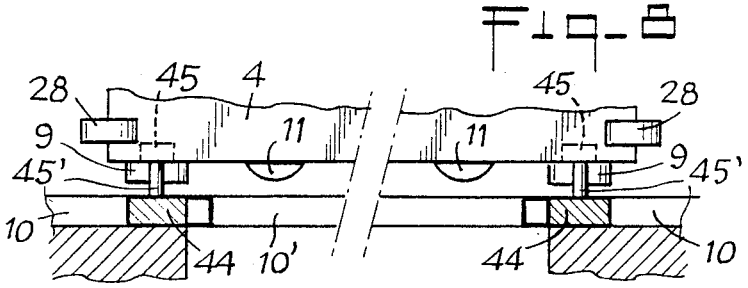
FIG. 8 is a partial section along VIII—VIII of FIG. 7, with a partial side view of a trolley of the invention parked on an intersection of the tracks.
Figure 7:
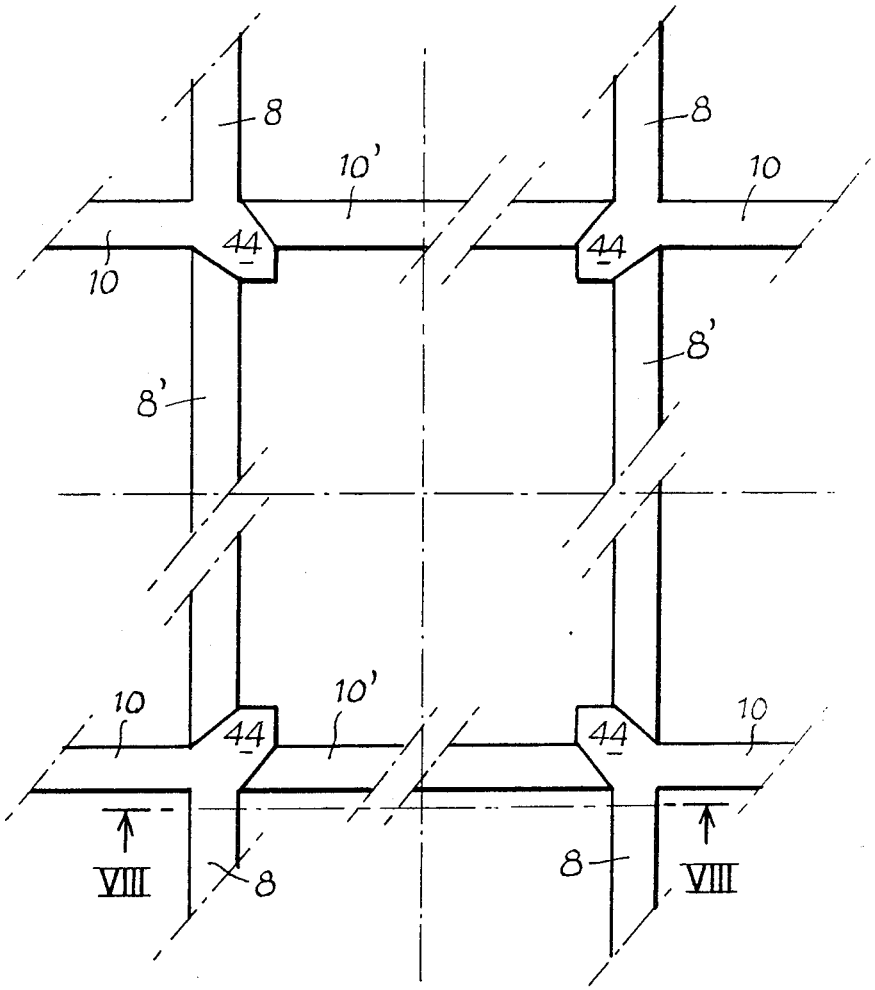
FIG. 7 is a plan view of an intersection of the tracks of FIG. 6.

The intersections 43 comprise vertically retractable tracks 8' and 10' and fixed ears 44. The function of ears 44 is to ensure the join of the fixed tracks 8 and 10 and the retractable tracks 8' and 10'. In the preferred embodiment, the ears have an additional function of support of the trolleys 4. The trolleys 4 are provided to this end with lifting jacks 45 disposed beneath the trolley, at the four corners (FIG. 3). For displacing trolley 4 from a pre-assembly site 42 onto a rolling site, for example, trolley 4 is displaced over tracks 10 up to an intersection 43. The trolley 4 is stopped at the intersection 43 where it rests by its wheels 11 on tracks 10'. Tracks 8' had been retracted in low position for this positioning. Once in place on the intersection 43, the trolley is raised by the jacks 45 of which the pistons 45' abut on the ears 44 (FIG. 8). The wheels 11 are therefore no longer supported by tracks 10' which may be lowered and tracks 8' may simultaneously be raised in order to re-establish the track 8. The trolley 4 is then lowered by jacks 45 to cause the wheels 9 to rest on the tracks 8'. The trolley 4 may then be displaced over tracks 8 towards the rolling site of the stand 1 which it transports. Without departing from the invention, it is also possible not to use jacks 45. In that case, in the preceding example, the trolley rests by its wheels 11 on tracks 10' until tracks 8'' are placed in high position for supporting the wheels 9 of the trolley 4. The tracks 10' may then be retracted in low position in order not to hinder displacement of the trolley 4 and the stand 1 on track 8. This latter variant presents the drawback of complicating the mechanism for retracting the tracks 8' and 10' and especially of prolonging the duration of track changes.

The system of the invention comprising the multifunction trolley and its associated devices for rapidly and precisely positioning the stands on the rolling sites, for displacing the stands perpendicularly to the rolling axis during rolling, for rapidly locking and unlocking the stands on the rolling sites and intersections, presents the following advantages:

rapid changes of rolling programmes, standardization of the trolleys which may receive stands of different dimensions and types, standardization of the tracks and intersections thereof which make it possible to place different stands on any site of the train, possibility of producing, with comparable productivity, on one and the same rolling mill, the complete range of sections, from the lightest to the heaviest, which could heretofore be produced only by three different trains (light train, medium train and heavy train). It has become possible, by a judicious arrangement and choice of the rolling sites, of the powers of the motors controlling the stands and of the tracks for displacements of the stand-bearing trolleys, to design a single seam enabling the rolling sections to be varied as desired.

What is claimed is:

1. A system for transferring section rolling mill stands from preassembly to rolling positions, adjusting the rolling plane of said stands, and displacing said stands perpendicularly to the rolling axis, said system comprising:

(a) longitudinal track sections and transverse track sections connecting said preassembly positions to said rolling positions, said track sections having parts forming intersections, said parts being retractable beneath the level of said track sections:

(b) counter-rails positioned alongside and extending above said track sections, said counter-rails having portions in said intersections retractable beneath the level of said tracks sections;

(c) at least one stand-bearing trolley on which a rolling mill stand may be mounted, each trolley comprising, two longitudinal members engaged with two transverse members to define four corners of said trolley, each of said longitudinal members having an outer lateral surface, an upper surface and supports beneath said upper surface, at least one of said transverse members having an outer surface with a coupling bar mounted therein, axle-less wheels rotatably mounted in said longitudinal and transverse members, each wheel in said longitudinal member rolling in the longitudinal direction when placed on one of said longitudinal track sections and each wheel in said transverse members rolling in the transverse direction when placed on one of said transverse track sections, on board motors mounted in said longitudinal and transverse members for driving said wheels, vertically rotating guide rollers rotatably mounted at each of said four corners, each guide roller having a surface of rotation extending beyond the periphery of said longitudinal and transverse members, said guide rollers rolling along said counter-rails when said trolley is rolling along said tracks for guiding said trolley along said tracks;

(d) mounting lugs attached to said rolling mill stand for supporting said stand on said trolley;

(e) shims insertable between the stand and trolley (f) first hydraulic jacks attached to said lugs for securing said stand to said trolley and for lifting said stand from said trolley when adjusting the rolling plane of the stand, each of said first hydraulic jacks comprising a piston extending into a longitudinal member through the upper surface thereof, said piston heads abutting on the undersides of the upper surfaces of said longitudinal members during retraction of said pistons, whereby said stand is drawn towards the trolley and secured thereto, said heads abutting said supports within said longitudinal members during extension of said pistons whereby said stand is lifted from said trolley and said shims may be placed between said stand and said trolley to adjust the rolling plane of said stand;

(g) bed plates upstream and downstream of said rolling positions, each bed plate having one or more second hydraulic jacks for lifting said trolley after said trolley has been properly positioned, each bed plate being shaped to engage one of said longitudinal member upper surfaces to restrain its vertical displacement, whereby said trolley may be lifted to a fixed height in each rolling position; and (h) means for precisely positioning said stand in each rolling position and for displacement of said stand perpendicularly to said rolling axis, said means comprising a third hydraulic jack and a coupling hook shaped to hook onto said coupling bar in said trolley.

2. The system of claim 1, wherein the longitudinal members are provided, on their outer lateral surfaces, with longitudinal shoes each having an upper surface inclined with respect to the horizontal and a horizontal lower surface.

3. The system of claim 2, wherein the longitudinal members comprise on their upper surfaces soles which abut the lugs of the stand, the soles having longitudinal slots with the pistons of the first jacks extending therethrough, the longitudinal members also comprising beneath the slots horizontal surfaces acting as said supports.

4. The system of claim 3, wherein said stand-bearing trolley is provided with lifting jacks placed at its corners so that the pistons of the lifting jacks can abut on surfaces lying beneath the stand-bearing trolley.

5. The system of claim 1, wherein said stand-bearing trolley is provided with lifting jacks placed at its corners so that the pistons of the lifting jacks can abut on surfaces lying beneath the stand-bearing trolley.

6. The system of claim 1, wherein the longitudinal members comprise on their upper surfaces soles which abut the lugs of the stand, the soles having longitudinal slots with the pistons of the first jacks extending therethrough, the longitudinal members also comprising beneath the slots horizontal surfaces acting as said supports.

7. The system of claim 6, further comprising fourth hydraulic jacks, mounted in said trolley and wherein at least the supports located on the same side of the transverse axis of symmetry of the stand-bearing trolley are moveable longitudinally with the aid of said fourth hydraulic jacks.

8. The system of claim 7, wherein said stand-bearing trolley is provided with lifting jacks placed at its corners so that the pistons of the lifting jacks can abut on surfaces lying beneath the stand-bearing trolley.

9. The system of claim 6, wherein said stand-bearing trolley is provided with lifting jacks placed at its corners so that the pistons of the lifting jacks can abut on surfaces lying beneath the stand-bearing trolley.

10. The system of claim 1, wherein said stand-bearing trolley is provided with lifting jacks placed at its corners so that the pistons of the lifting jacks can abut on surfaces lying beneath the stand-bearing trolley for lifting said trolley.

11. The system of claim 1, comprising fixed ears fast with the track sections and extending into the intersections, said ears being flush with the retractable track portions and serving as supports for the lifting jacks when said trolley is in said intersections.

12. The system of claim 1, further comprising shoes mounted on said stand-bearing trolleys, said shoes having upper surfaces and lower horizontal surface, and wherein said bed plates have beneath their upper surfaces, on the one hand, surfaces which make an angle with the horizontal, said angle being the supplement of the angle of the upper surfaces of the shoes of the stand-bearing trolley, and, on the other hand, lifting jacks having pistons placed so that the pistons may abut against the lower horizontal surfaces of the shoes.

* * * * *